US011199374B2

(12) United States Patent
Washburn, III et al.

(10) Patent No.: US 11,199,374 B2
(45) Date of Patent: Dec. 14, 2021

(54) FIRING MECHANISM OF A FIREARM

(71) Applicant: Centre Firearms Co., Inc., Ridgewood, NY (US)

(72) Inventors: Richard Ryder Washburn, III, Ridgewood, NY (US); Juan D. Cabrera, Ridgewood, NY (US); Andrew Lees, Ridgewood, NY (US); Richard Ryder Washburn, II, Ridgewood, NY (US)

(73) Assignee: CENTRE FIREARMS CO., INC., Ridgewood, NY (US)

( * ) Notice: Subject to any disclaimer, the term of this patent is extended or adjusted under 35 U.S.C. 154(b) by 0 days.

(21) Appl. No.: 17/090,074

(22) Filed: Nov. 5, 2020

(65) Prior Publication Data

US 2021/0270557 A1 Sep. 2, 2021

Related U.S. Application Data

(63) Continuation of application No. 16/780,947, filed on Feb. 4, 2020, now Pat. No. 10,852,090, which is a continuation of application No. 16/039,381, filed on Jul. 19, 2018, now Pat. No. 10,578,388.

(51) Int. Cl.

| | |
|---|---|
| ***F41A 3/76*** | (2006.01) |
| ***F41A 19/52*** | (2006.01) |
| ***F41A 19/10*** | (2006.01) |
| *F41A 19/53* | (2006.01) |

(52) U.S. Cl.

CPC ..... *F41A 19/52* (2013.01); *F41A 3/76* (2013.01); *F41A 19/10* (2013.01); *F41A 19/53* (2013.01)

(58) Field of Classification Search

CPC .... F41A 19/52; F41A 3/76; F41A 3/74; F41C 3/14; F41C 3/10

USPC ..... 89/26; 42/59

See application file for complete search history.

(56) References Cited

U.S. PATENT DOCUMENTS 182,646 A * 9/1876 Davis ..... F41A 3/76 42/59

970,248 A * 9/1910 Lisle ..... F41A 9/28 42/59

FOREIGN PATENT DOCUMENTS

GB 190915753 A * 2/1910 ..... F41A 3/76

OTHER PUBLICATIONS

Washburn III et al., "Firing Mechanism of a Firearm", U.S. Appl. No. 16/780,947, filed Feb. 4, 2020.

* cited by examiner

*Primary Examiner* — Reginald S Tillman, Jr.

(74) *Attorney, Agent, or Firm* — Duane Morris LLP

(57) ABSTRACT

A firing mechanism for a firearm includes a trigger, a forcing structure, and a spring within a cylinder, wherein while the trigger is pulled, the forcing structure moves to force the cylinder to contact a barrel and to force the spring to compress, and while the trigger is returned to an idle position, the forcing structure moves to allow the spring to decompress and to force the cylinder away from the barrel.

10 Claims, 10 Drawing Sheets

FIRING MECHANISM OF A FIREARM

CROSS REFERENCE TO RELATED APPLICATIONS

This application claims the benefit of U.S. patent application Ser. No. 16/039,381, filed Jul. 19, 2018, now U.S. Pat. No. 10,578,388; and Ser. No. 16/780,947 filed Feb. 4, 2020, which are each hereby incorporated by reference for all purposes as if fully set forth herein.

BACKGROUND OF THE INVENTION

1. Field of the Invention

The present invention relates to a mechanism and a method used in firing firearms, in particular, a firearm with an unsealed breech or a revolving cylinder. More specifically, the present invention relates to a firing mechanism that seals a gap between the breech or revolving cylinder and a barrel of a firearm to contain cartridge propellant gases, to increase safety, and to suppress the noise and flash created by a fired cartridge.

2. Description of the Related Art

A revolver is a handgun, or pistol, that has a barrel and a revolving cylinder that includes multiple chambers that retain cartridges. The revolver allows a user to fire multiple rounds without reloading after every shot and requires manual ejection of spent cartridges and reloading of new cartridges. Unlike a semiautomatic handgun, the spent casings of the cartridges are not ejected after each shot, but stay within the cylinder chamber. Before a round is fired, a hammer usually including the firing pin is cocked, either by the shooter manually or by rearward movement of the trigger that rotates the cylinder and that aligns the next chamber with the barrel.

Conventional revolvers have a unique problem in that, unlike semiautomatic handguns or rifles, the path of the propellant gas is not sealed completely along an entire path between the cartridge and the muzzle. When a cartridge is fired in a revolver, the expanding propellant gas momentarily expands the cartridge casing in the cylinder and seals the space between the cartridge casing and cylinder to force the gas forward into the barrel. However, the gap between the cylinder and the barrel in a revolver is in a location where hot burning propellant gases can escape in a substantially perpendicular direction to the longitudinal axis of the barrel before reaching the muzzle. This spacing between the cylinder and the barrel is provided to allow the cylinder to rotate during the firing action without impinging on or interfering with the rear portion of the barrel and to accommodate dimensional tolerances suited for mass-production of the various revolver components.

A breech-loading gun is a firearm in which the cartridge or shell is inserted or loaded into a firing chamber integral with the rear portion of a barrel. The main advantage of breech-loading is a reduction in reloading time compared to muzzle loading. The main challenge of breech-loading firearms is sealing the breech as an unsealed breech lowers propellant gas pressure and muzzle velocity, and creates safety issues for the shooter.

An unsealed breech does not prevent blowback or escape of cartridge propellant gas in the direction of the shooter, causing unsafe conditions. Typically, overcoming the problem of an unsealed breech is a very delicate balance between loose enough tolerances in the breech-loading mechanism to allow the firearm to function under conditions of extreme dirt and powder fouling, and the effective sealing of the breech against propellant gas leakage by the very slight expansion of the typically soft brass cartridge during firing or obturation.

The propellant gases exiting the gap between the firing chamber and the barrel cause a safety hazard to a user's hand holding the handgun that is inches away, and to any person or object near or adjacent to the firearm when a round is discharged. Being struck by this heated gas causes the potential for serious injury. There is also the possibility of breathing unburned powder or lead shaved from the round caused by less than perfect alignment between the moving bullet, the chamber the bullet is exiting, and the barrel.

Furthermore, noise caused by the use of a firearm is mostly associated with the rapid expansion of the propellant gas produced when the powder inside the cartridge ignites. When propellant gas rapidly expands and collides with cooler air, normally in and around the end of the barrel, i.e. the muzzle of the firearm, a loud bang sound occurs. Noise suppression devices used with firearms are used to reduce the noise attributable to this phenomenon to provide stealth or mitigate hearing loss and noise pollution. Noise suppression devices attached to the muzzle have been in use at least since the late nineteenth century, but noise produced by revolvers is notoriously difficult to suppress.

In general, noise suppression devices reduce the noise associated with the rapid expansion of propellant gas by slowing the propellant gas. Slowing the propellant gas allows the propellant gas to expand more gradually and to cool before it collides with the air in and around the muzzle of the firearm. There is enough room in this gap that the escaping gases are a large source of noise and flash cannot be suppressed using only conventional suppressor devices attached to the muzzle. Several techniques have been used to attempt to overcome this mechanical issue and to suppress noise in a revolver with a gap between the firing chamber and the barrel.

One technique provides a sealed mechanical box or clamshell device surrounding at least the entire cylinder and proximal portion of the barrel to enclose the propellant gas escaping from the gap with sound absorbing material. This technique adds bulk and weight to the handgun and needs to be removed before reloading the cylinder.

Another technique used to suppress revolver noise is to use a special rimless cartridge that emits no report or flame because all of the propellant gases are retained in the casing. This "silent" type of cartridge uses a piston between the charge and the bullet. When fired, the piston pushes the bullet out of the cartridge and then remains captive to seal the casing, preventing the propellant gases from escaping. The effective range of this type of cartridge is severely limited.

The Nagant M1895 Revolver uses a gas-sealed system including a proprietary cartridge in which the cylinder is moved forward when the gun is cocked to close the gap between the cylinder and the barrel. In a cartridge used with the Nagant M1895 Revolver, the bullet is deeply seated and entirely within the casing, and the mouth of the casing is slightly reduced in diameter compared to the remainder of the casing. The proximal end of the revolver barrel is conically shaped. When the hammer is cocked, the cylinder turns first and then moves forward sealing the mouth of the cartridge to the conical portion of the barrel. This provides an increased muzzle velocity and suppression. On the other hand, in addition to the requirement for a non-standard cartridge, because the cylinder is firmly attached at the front and rear of the frame, a major disadvantage of the Nagant M1895 design is the need to manually remove each used casing and reload the chambers one at a time through a loading gate.

SUMMARY OF THE INVENTION

To overcome the problems described above, preferred embodiments of the present invention provide firing mechanisms for revolvers and firearms each with an unsealed breech, and methods of firing firearms, using standard ammunition, that each contain cartridge propellant gases to suppress the noise and flash created by a fired cartridge and to increase safety.

A firing mechanism for a firearm includes a trigger; a forcing structure; and a spring within a cylinder; wherein while the trigger is pulled, the forcing structure moves to force the cylinder to contact a barrel and to force the spring to compress, and while the trigger is returned to an idle position, the forcing structure moves to allow the spring to decompress and to force the cylinder away from the barrel.

The firing mechanism can include a spring in a bore of the cylinder. The spring can be helical and retained between the cylinder and a crane.

The firing mechanism can include a barrel including a conical taper at a rear end of the barrel, and the cylinder can include a conically tapered counter bore at a front end of a chamber closest to the barrel. The conically tapered counter bore fits over the conical taper at the rear end of the barrel and seals or substantially seals the barrel and the conically tapered counter bore.

In the firing mechanism, the forcing structure can include a latch pin lever and a latch pin, wherein the latch pin lever pivots to force the latch pin in a direction parallel or substantially parallel to a bore of the barrel.

In the firing mechanism, a direction of movement of the latch pin lever can be perpendicular or substantially perpendicular to a direction of movement of the latch pin. Further, in the firing mechanism, the latch pin lever can include an angled surface such that a vertex of an angle of the angled surface extends in a direction toward the latch pin, and the angled surface is in slideable contact with the latch pin.

In the firing mechanism, the latch pin can include a groove that is in slideable contact with the latch pin lever.

Because the gap between the barrel and chamber is sealed, there is no leak, and substantially all of the propellant gas is used to propel the bullet. This containment increases muzzle velocity of the bullet, increases accuracy, negates a need for a higher cartridge load to achieve the same muzzle velocity, and achieves the design balance needed between loose breech mechanism tolerances and very tight cartridge expansion tolerances.

Safety is improved by forcing substantially all of the propellant gas to exit the muzzle. This moves a source of extremely hot propellant gas away from the shooters' hands and anyone next to the shooter or the firearm. Forcing substantially all of the propellant gas forward, away from the shooter, also significantly reduces the toxic fumes, unignited gunpowder, and bullet lead exposure to the shooter and those nearby.

The ability to suppress a firearm is significantly increased. With substantially all of the propellant gas exiting the muzzle, noise and flash suppressors mounted to the muzzle can be used without a need for a separate device to contain or suppress propellant gas exiting from the gap between the rear end of the barrel and the chamber.

A non-custom, commercially available cartridge can be used in the firearm.

The built-in safety features of a firearm, such as a transfer bar, cylinder latch, or the like, are not adversely affected by the preferred embodiments of the present invention.

The above and other features, elements, characteristics, steps, and advantages of the present invention will become more apparent from the following detailed description of preferred embodiments of the present invention with reference to the attached drawings.

DETAILED DESCRIPTION OF PREFERRED EMBODIMENTS

Firing mechanisms used with revolvers, in accordance with exemplary preferred embodiments as disclosed herein, are representative of firearms with unsealed breeches, and are assembled within a revolver and capable of being activated as part of the firing action of a conventional revolver.

Figure 1:
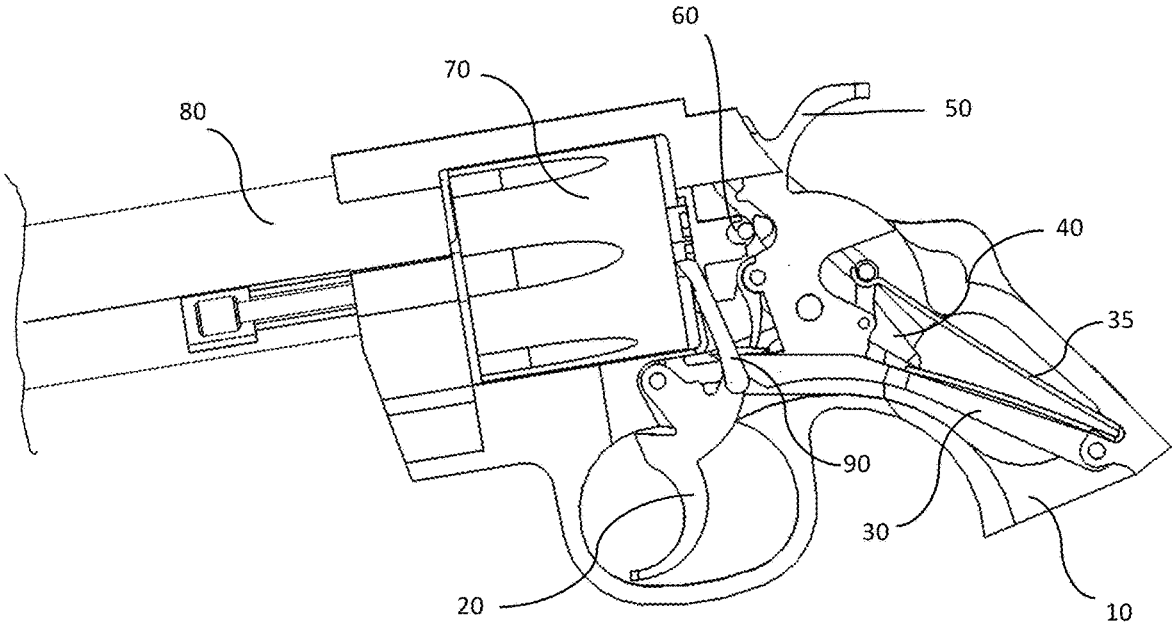
FIG. 1 is a cross sectional view of a revolver showing components of a firing mechanism according to a first preferred embodiment of the present invention.
Figure 2:
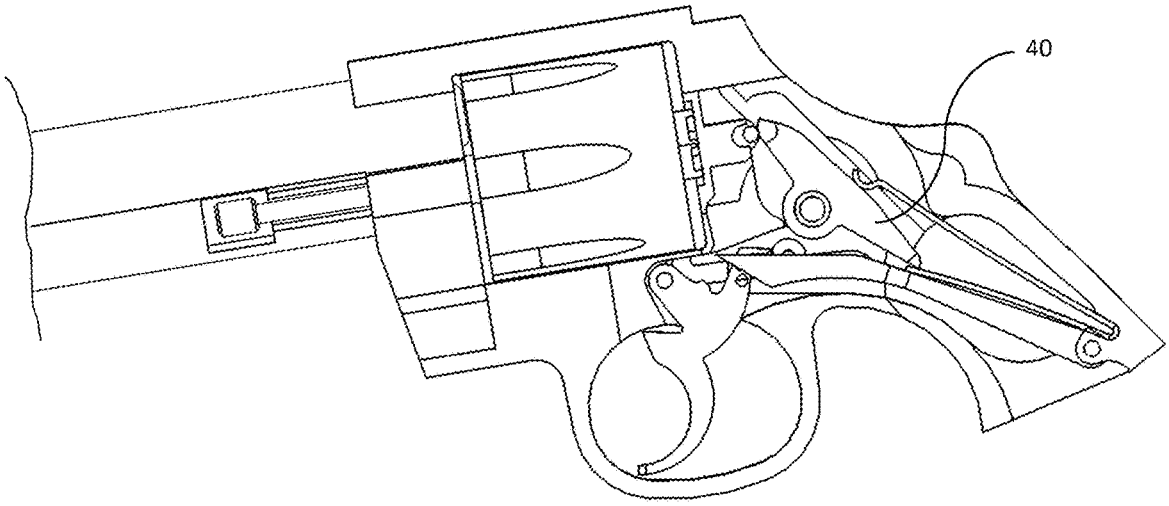
FIG. 2 is a cross sectional view of a revolver showing components of a firing mechanism according to a preferred embodiment of the present invention.

FIG. 1 is a cross sectional view of a revolver showing components of a firing mechanism according to a first preferred embodiment of the present invention. FIG. 1 shows components including a frame 10, a trigger 20, a rebound lever 30, a main spring 35, a latch pin lever 40, a hammer 50, a cylinder latch pin 60, a cylinder 70, and a barrel 80. FIG. 2 shows the same view as FIG. 1 with the hammer and other components removed to better view the latch pin lever 40 located behind the hammer 50. The firing mechanism shown in FIG. 1 can operate in single or double action.

Figure 3:
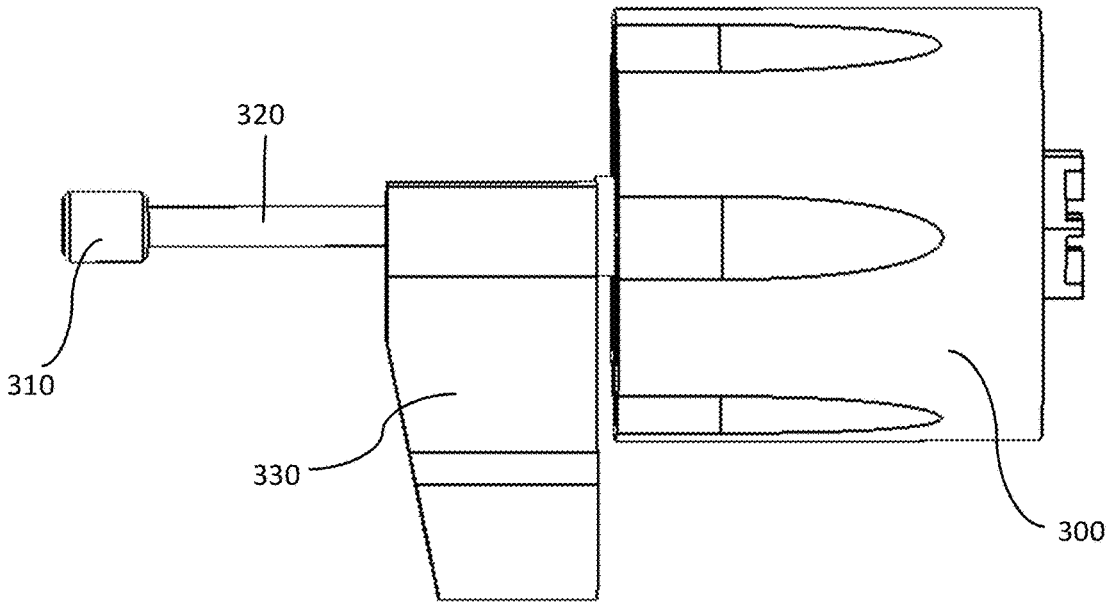
FIG. 3 is a side view of a cylinder assembly according to a preferred embodiment of the present invention.
Figure 4:
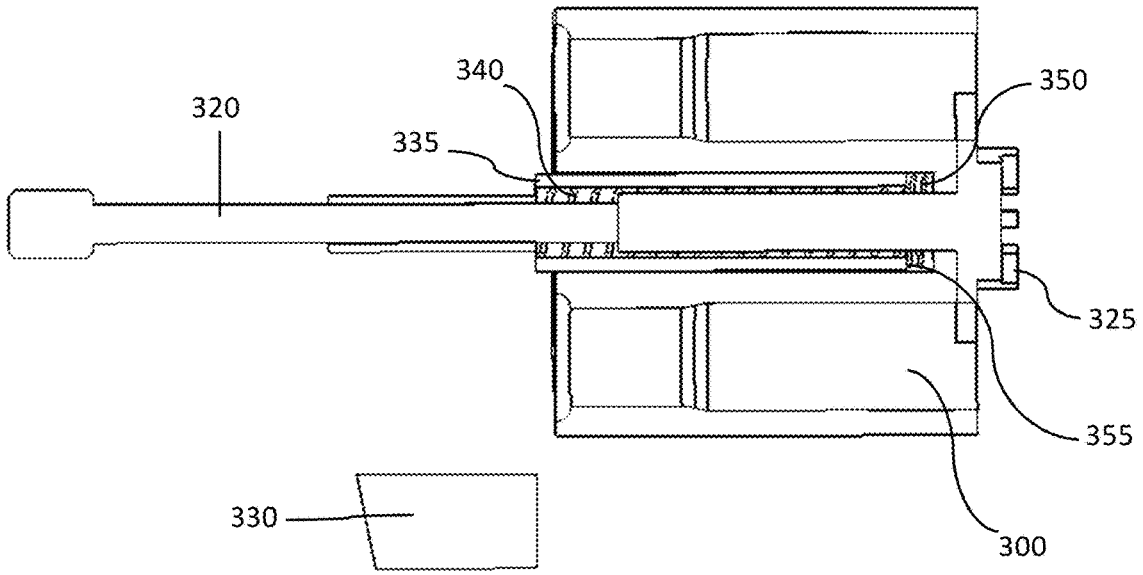
FIG. 4 is a cross sectional view of the cylinder assembly shown in FIG. 3.

FIG. 3 is a side view of a cylinder assembly according to a preferred embodiment of the present invention. FIG. 3 shows a cylinder 300, an ejector rod head 310, an ejector rod 320, and a crane 330. FIG. 4 is a cross sectional view of the cylinder assembly shown in FIG. 3. A large portion of the crane 330 is not shown due to the sectional view. As known in the art and not shown, a portion of the crane 330 is typically locked into the frame 10 of the revolver so that it cannot move in the longitudinal direction with respect to the barrel 80 and the frame 10, but can be released and rotated laterally bringing the cylinder 70 outside the frame 10 to expose the chambers to load cartridges and to unload spent casings.

FIG. 4 shows an internal configuration of the cylinder assembly that includes a cylindrical portion 335 of the crane 330 that has a bore completely through, that fits inside a central bore of the cylinder 300, and that allows the ejector rod 320 to pass through. Also seen in FIG. 4 is a helical ejector spring 340 and a helical cylinder spring 350, both of which the ejector rod 320 passes through.

FIG. 4 shows that the cylinder spring 350 can be located in the rear portion of the central bore of the cylinder 300 closest to a ratchet portion 325 of the ejector rod 320. The outer diameter of the cylinder spring 350 is less than the inner diameter of the central bore of the cylinder 300 so that it fits within the central bore of the cylinder 300. The cylinder spring 350 can be retained and compressed between the central bore of the cylinder 300 and a keeper 355, a device that retains the cylinder spring 350. FIG. 4 shows the keeper 355 as an end surface of the cylindrical portion 335 of the crane 330. Optionally, the keeper 355 can be a bushing, snap ring, sleeve, coupling, insert, fastener, or any device that retains the cylinder spring 350 within the cylinder 300.

Optionally, it is possible a bushing, a washer, or the like can be included as a buffer between the end surface of the keeper 355 (shown as the end surface of the cylindrical portion 335 of the crane 330) and the cylinder spring 350. FIG. 4 further shows that the ejector spring 340 is located within the cylindrical portion 335 of the crane 330 and retained by a step defined by a reduced diameter of the cylindrical portion 335 at the fore end and either the compression spring 350 or a bushing (the bushing is not shown in FIG. 4) at the other end.

Referring to FIG. 1, in a stationary or idle position, a portion of one end of the rebound lever 30 is in contact with a flange or groove on the trigger 20, one end of the latch pin lever 40 is in contact with the main spring 35, another end of the latch pin lever 40 is in contact with one end of the cylinder latch pin 60, and the other end of the cylinder latch pin 60 is in contact with the cylinder 70.

In the firing sequence of a revolver, when pulled, the trigger 20 pushes the hammer 50 backwards to compress the main spring 35 (shown in this configuration as wishbone-shaped) while a pawl 90 attached to the trigger 20 pushes against a ratchet to rotate the cylinder 70 and align the next chamber with the barrel 80 and hammer 50. When the trigger 20 reaches all the way back, the hammer 50 is released and the compressed main spring 35 forces the hammer 50 forward. The firing pin on the hammer 50 strikes the primer on the cartridge that ignites the propellant. The pawl 90 resets its position when the trigger 20 is returned to the starting location. A firing sequence of a firearm with an unsealed breech can work similarly without the need to rotate a cylinder.

The firing mechanism shown in FIG. 1 operates simultaneously with the firing sequence described above such that while the trigger 20 is being pulled back, the trigger 20 rotates with respect to the frame 10 and pushes against a portion of the rebound lever 30 so that the rebound lever 30 pivots with respect to the frame 10. The motion of the rebound lever 30 compresses the main spring 35 and forces the latch pin lever 40 to rotate and generate force to push the cylinder latch pin 60 against the cylinder 70, compress the cylinder spring (cylinder spring 350 is shown in FIG. 4), and force the cylinder 70, or unsealed chamber, forward towards the barrel 80 to close the gap between the cylinder 70 and the barrel 80 after the next chamber is aligned with the barrel 80. The forward motion of the cylinder 70 engages the forward portion of the chamber that is aligned with the barrel 80 with the rear portion of the barrel 80 and seals the chamber with the barrel 80 to eliminate any gap and to block emission of the propellant gas between the cylinder 70 and the barrel 80.

After firing, while the trigger 20 is returning to the idle position, the force on the cylinder latch pin 60 against the cylinder 70 is released and the cylinder spring forces the cylinder 70 rearward to disengage the aligned chamber from the barrel 80 and return the cylinder 70 to the idle position.

Figure 5:
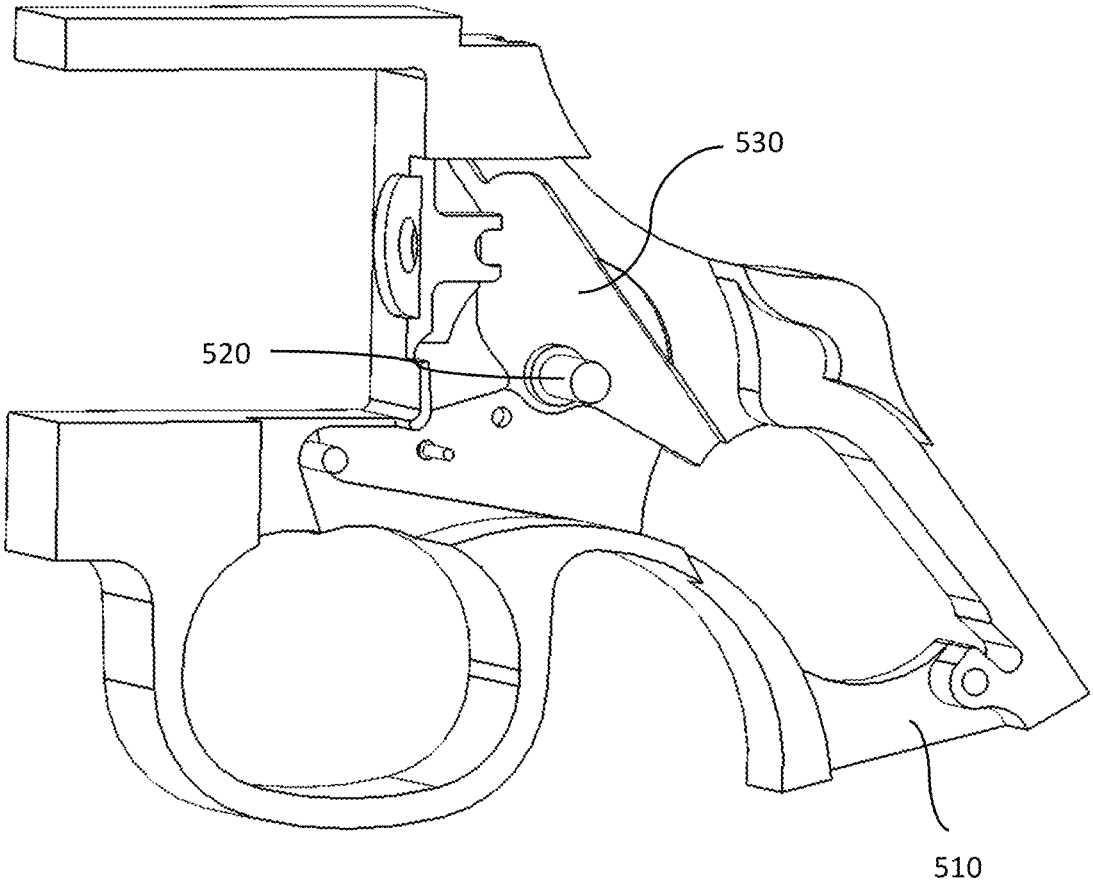
FIG. 5 is a perspective view of a portion of a frame according to a preferred embodiment of the present invention.

FIG. 5 is a perspective view of a portion of a frame 510 according to a preferred embodiment of the present invention. As shown in FIG. 5, the frame 510 can include a cylindrical protrusion 520 and a recess 530. The protrusion 520 and the recess 530 are configured so that the latch pin lever (not shown in FIG. 5) can pivot and rotate about the protrusion 520 while seated within the recess 530. Additionally, the protrusion 520 can provide a pivot location for rotation of the hammer (not shown). The protrusion 520 and the recess 530 can be formed into the frame 510 by machining, casting, molding, or the like. Also, the protrusion 520 can be a separate component such as a pin, post, screw, or the like that is pressed, screwed, or bonded to the frame 510. Optionally, the protrusion 520 can include portions with different diameters to assist in locating the latch pin lever and the hammer and to distribute wear from friction forces generated during rotational movement.

The frame 510 can be made of metal, plastic, ceramic, composite, or any material suitable for the purpose of providing the main structural support of a firearm, such as a revolver or a firearm with an unsealed breech. Likewise, the protrusion 520 can be made of metal, plastic, ceramic, composite, or any material suitable for the purpose of providing a pivot location for the latch pin lever and the hammer.

Figure 6A:
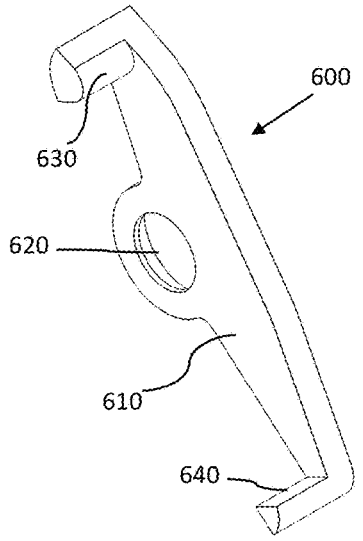
FIG. 6A is a perspective view of a latch pin lever according to a preferred embodiment of the present invention.
Figure 6B:
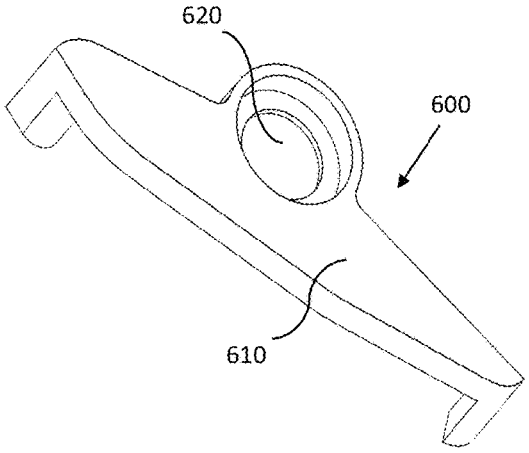
FIG. 6B is a perspective view of a latch pin lever according to a preferred embodiment of the present invention.

FIGS. 6A and 6B are perspective views of a latch pin lever 600 according to a preferred embodiment of the present invention. As shown in FIGS. 6A and 6B, the latch pin lever 600 can include a body 610 with a hole 620 and two protrusions as an upper flange 630 and a lower flange 640 at opposite ends of the body 610. As seen in FIGS. 6A and 6B, the body 610 can be generally flat, except for the upper flange 630 and the lower flange 640, and have a length and width that are greater than the thickness, although other configurations are possible. The latch pin lever 600 can be made of metal, plastic, ceramic, composite, or any suitable material.

The diameter and location of the hole 620 are configured such that the latch pin lever 600 can be inserted so that the protrusion of the frame (shown in FIG. 5) fits through the hole 620 and allows the latch pin lever 600 to rotate with respect to the protrusion. FIG. 6B shows that the hole 620 can include a counter bore to fit over a wider diameter that can be at the base of the protrusion. Once inserted over the protrusion of the frame, the rear flat surface of the body 610 can fit into the recess of the frame and glide freely during movement as part of the firing action. The front flat surface of the body 610 can be in contact with a flat rear surface of the hammer and allow the latch pin lever 600 and the hammer to freely move relative to each other and the frame.

The upper flange 630 is configured to contact the latch pin and provide a force to push the latch pin forward as part of the firing action (as described above). The outer surface of the upper flange 630 that contacts the latch pin is curved to provide a small contact area with the latch pin and allow relative movement of the latch pin contact position along the curved surface during movement as part of the firing action.

The lower flange 640 is configured to contact the main spring or rebound lever and receive a force from the rebound lever while the rebound lever is moved as part of the firing action. As shown in FIG. 6A, the outer surface of the lower flange 640 that contacts the main spring or rebound lever is generally flat to match the generally flat surface of the main spring and allow the lower flange 640 to slide along the main spring during movement of the firing action.

Figure 7A:
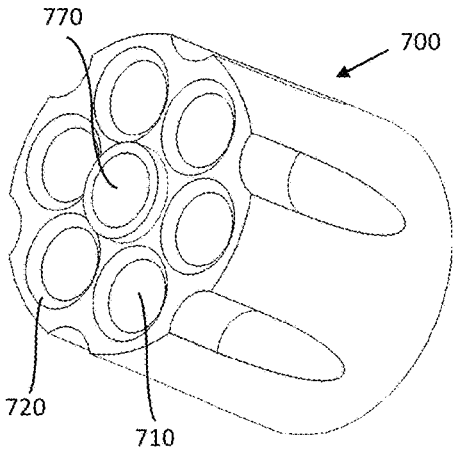
FIG. 7A is a perspective view of a cylinder according to a preferred embodiment of the present invention.
Figure 7B:
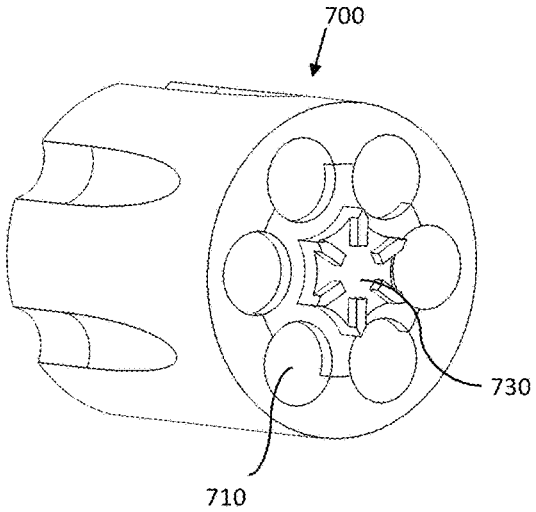
FIG. 7B is a perspective view of a cylinder according to a preferred embodiment of the present invention.

FIGS. 7A and 7B are perspective views of a cylinder 700 according to a preferred embodiment of the present invention. As shown in FIGS. 7A and 7B, the cylinder 700 has a generally cylindrical shape as is known in the art. The cylinder 700 can include a body with a central bore 770 and a plurality of chambers 710 that are holes bored through the cylinder 700 to a diameter that will accommodate a desired cartridge size or caliber ammunition. Any number of chambers 710 is possible. It is contemplated that a firearm with an unsealed breech will have a single chamber. FIG. 7A shows that all of the chambers 710 include a uniformly tapered portion 720 at the end the chambers 710 closest to the barrel. As shown, the tapered portion 720 has a diameter slightly larger than the remaining portion of the chamber 710 starting at the outside surface of the cylinder 700 and narrowing to the diameter of the bored chamber 710. The angle and depth of the tapered portion 720 matches a conical taper of the end of the barrel such that, when pushed forward during the firing action, the chamber 710 aligned with the barrel fits over the barrel and seals the path of the propellant gas so that the propellant gas can only exit via the muzzle of the barrel.

FIG. 7B shows a rear view of the cylinder 700 including the chambers 710 without a tapered end, and a central portion 730 of the ratchet where the latch pin contacts the cylinder 700.

Figure 8:
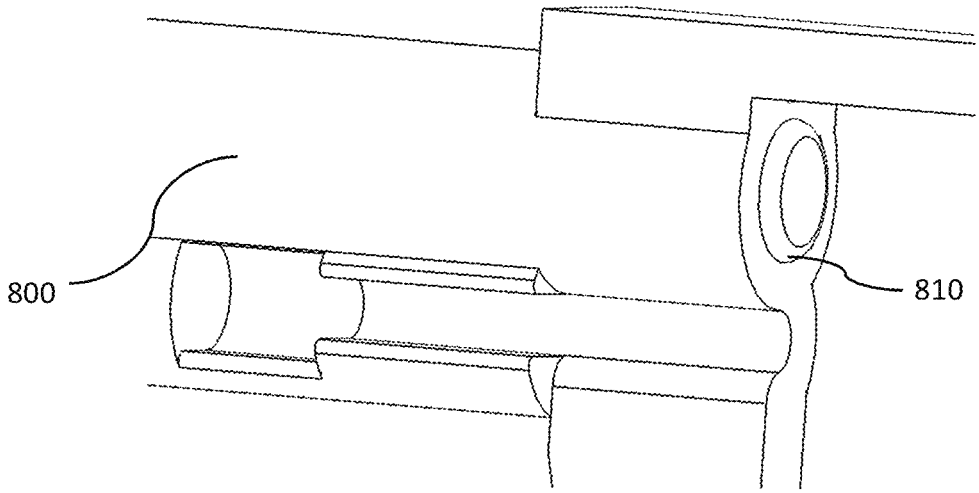
FIG. 8 is a perspective view of a portion of a barrel according to a preferred embodiment of the present invention.

FIG. 8 is a perspective view of a portion of a barrel 800 according to a preferred embodiment of the present invention. Although other shapes are possible, the barrel 800 has a generally cylindrical shape with a bore completely through a longitudinal axis as is known in the art. However, FIG. 8 shows that the barrel 800 includes a conical taper 810 at the end of the barrel 800 closest to the cylinder (the cylinder is not shown in FIG. 8 for clarity). As discussed above, the angle and depth of the conical taper 810 matches a taper of the end of the chambers such that when the cylinder is pushed forward during the firing action the conical taper 810 at the end of the barrel 800 fits into the tapered portion of the chamber to form a seal. Thus, the propellant gas is substantially obstructed at this location and cannot be released between the barrel 800 and the chamber.

Forming a substantially obstructed seal between the barrel and the chamber while firing a firearm provides several advantages. Because there is no leak, substantially all of the propellant gas is used to propel the bullet, which increases muzzle velocity for the bullet, increases accuracy, and negates a need for a higher cartridge load to achieve the same muzzle velocity. Additionally, safety is improved. Forcing substantially all of the propellant gas to exit the muzzle moves a source of extremely hot propellant gas away from the shooters' hands and anyone next to the shooter or the firearm. Forcing all of the propellant gas forward away from the shooter also significantly reduces the toxic fumes, unignited gunpowder, and bullet lead exposure to the shooter. Moreover, the ability to suppress noise in a revolver is significantly increased. With substantially all of the propellant gas exiting the muzzle, noise and flash suppressors mounted to the muzzle can be used without a need for a clam shell or other device to contain or suppress the propellant gas exiting from the gap between the rear end of the barrel and the chamber of conventional revolvers and firearms with an unsealed breech. All of these advantages can be achieved without the need for custom cartridges and do not affect the built-in safety features of conventional firearms.

Figure 9:
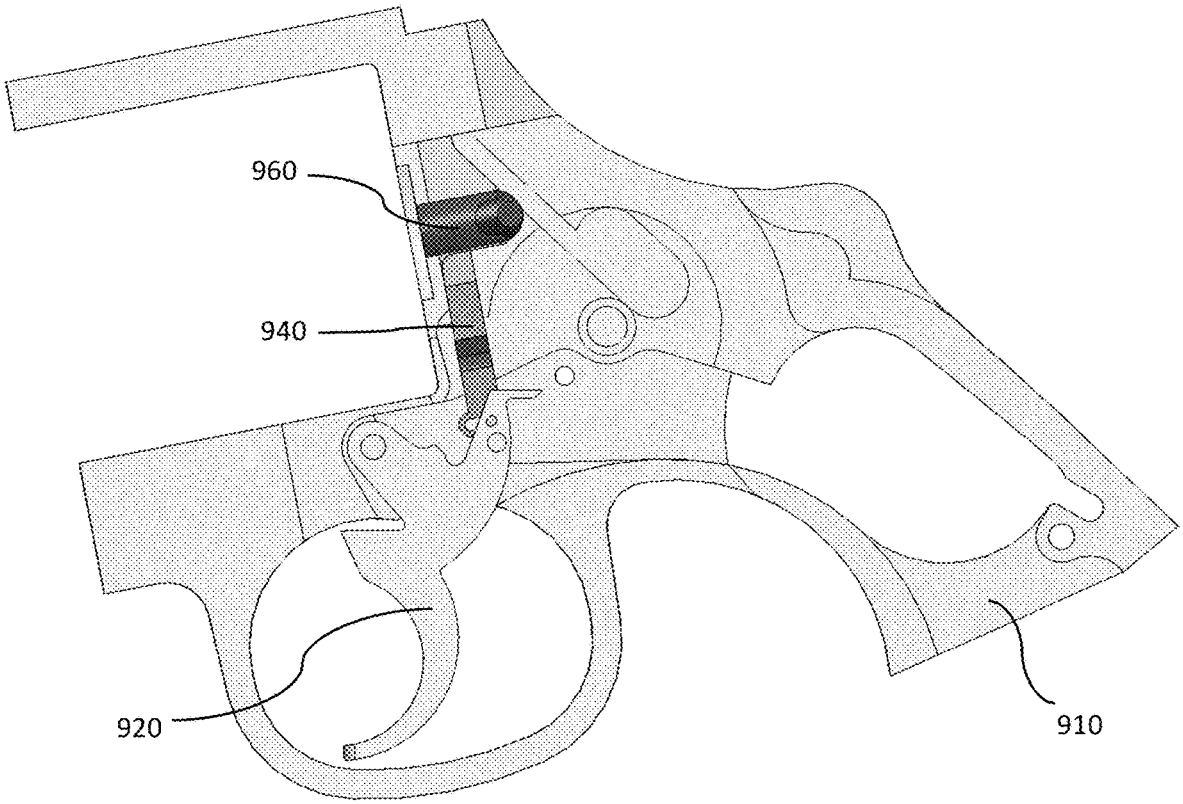
FIG. 9 is a cross sectional view of a revolver showing components of a firing mechanism according to a second preferred embodiment of the present invention.
Figure 10:
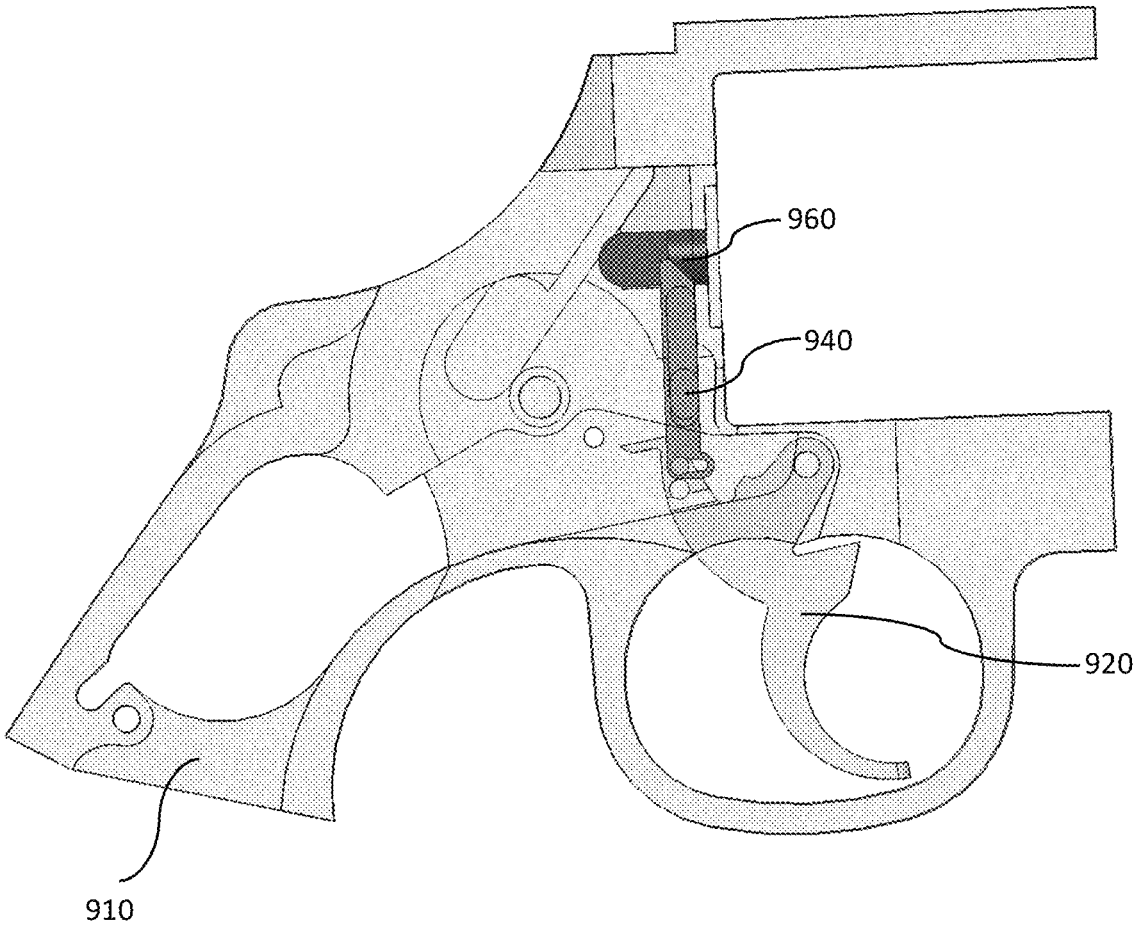
FIG. 10 is a cross sectional view of a revolver showing components of a firing mechanism according to a second preferred embodiment of the present invention.

FIGS. 9 and 10 are cross sectional views of a revolver showing components of a firing mechanism according to a second preferred embodiment of the present invention. FIGS. 9 and 10 show several components that are similar to that of the first preferred embodiment and also a different configuration of some components. Images and descriptions of like components to that of the first embodiment including the rebound lever, hammer, cylinder assembly, and barrel are omitted for brevity.

FIGS. 9 and 10 show components including a frame 910, a trigger 920, a latch pin lever 940, and a cylinder latch pin 960. The firing mechanism shown in FIGS. 9 and 10 can operate in single or double action. FIG. 9 shows a front view, and FIG. 10 shows a rear view with the frame 910 drawn as transparent so components on the rear side of the view are visible.

One end of the latch pin lever 940 is in contact with the trigger 920 and another end of the latch pin lever 940 is in contact with the latch pin 960. As the trigger 920 rotates, the latch pin lever 940 also moves. As the trigger 920 is pulled, the latch pin lever 940 moves upward and forces the latch pin 960 against the cylinder (not shown in FIG. 9) to move the cylinder forward to seal the aligned chamber to the barrel, as previously described with respect to the first preferred embodiment. As the trigger 920 is released and rotatably returns to the idle position, the cylinder spring forces the cylinder rearward against the latch pin 960 to move the latch pin 960 and the latch pin lever 940 to their idle position.

FIG. 9 shows that the latch pin lever 940 includes a slot or opening that fits over a protrusion on the trigger 920 and is in slideable contact with the protrusion. As the trigger 920 rotates during the firing action, the protrusion also rotates to apply a force against the latch pin lever 940 to move the latch pin lever 940 and consequently the latch pin 960.

Figure 11:
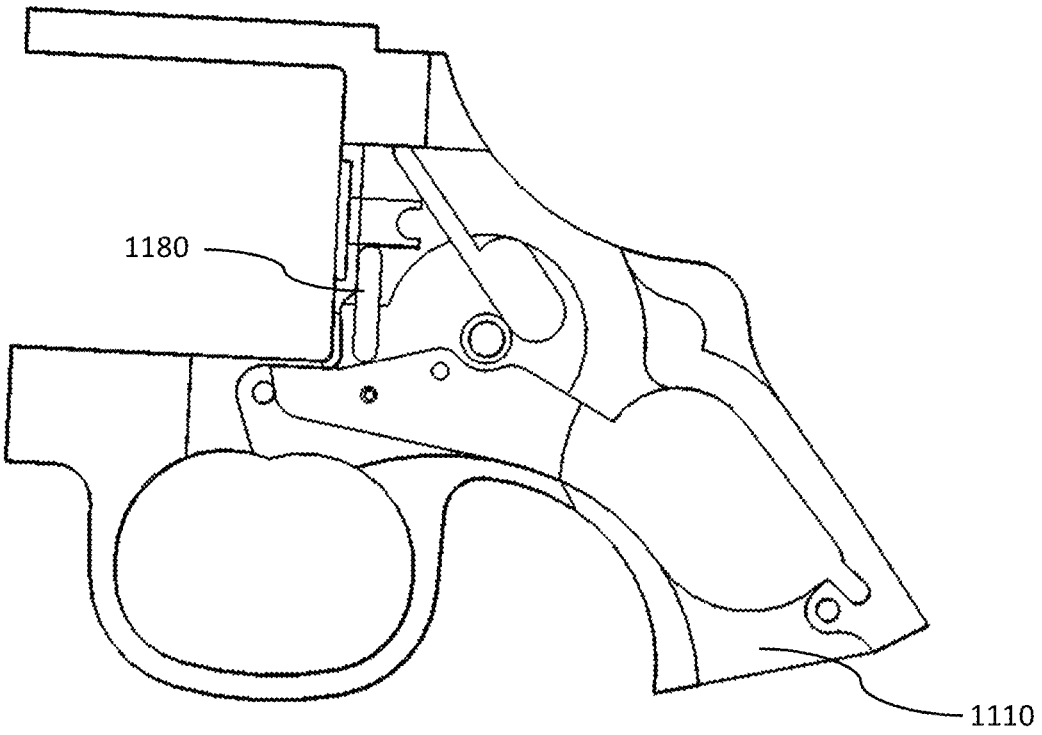
FIG. 11 is a side view of a frame according to a preferred embodiment of the present invention.

FIG. 11 shows a frame 1110 according to a preferred embodiment of the present invention. FIG. 11 shows that the frame 1110 can include a recess 1180 that retains the latch pin lever (not shown in FIG. 11). Although other shapes are possible, the recess 1180 is shown as an oval or elliptical shape that is larger than a protrusion on the latch pin lever to allow the latch pin lever to move as intended with respect to the frame 1110 but is constrained from moving in all directions by interference between the sides of the recess and sides of the protrusion on the latch pin lever, as discussed below.

Figure 12:
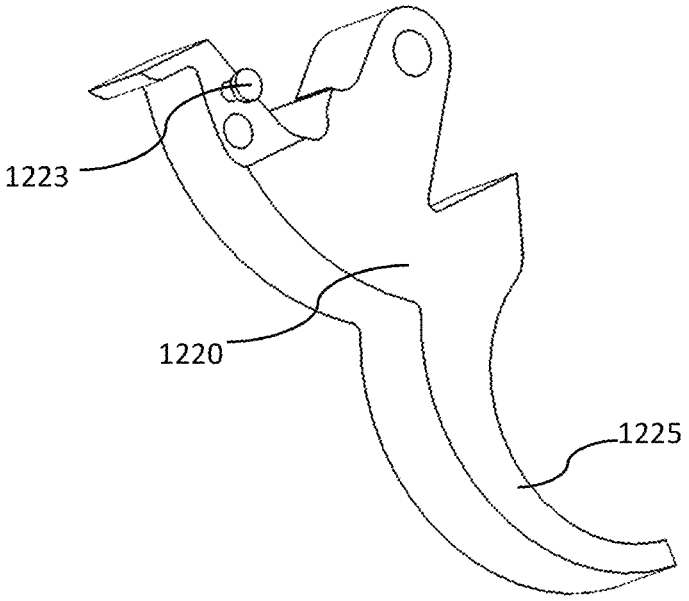
FIG. 12 is a perspective view of a trigger according to a preferred embodiment of the present invention.

FIG. 12 shows a trigger 1220 according to a preferred embodiment of the present invention. The trigger 1220 can include a cylindrical protrusion 1223. The protrusion 1223 is shown in a portion of the trigger 1220 that is rearwardly extended from a curved finger portion 1225. The protrusion 1223 can be integrally defined in the trigger 1220 or provided as a separate pin or post that is press fit or fastened to the body of the trigger 1220. Further, the protrusion 1223 may include a head portion that is wider than the body of the protrusion to help in maintaining slidable contact in a slot of the latch pin lever.

Figure 13A:
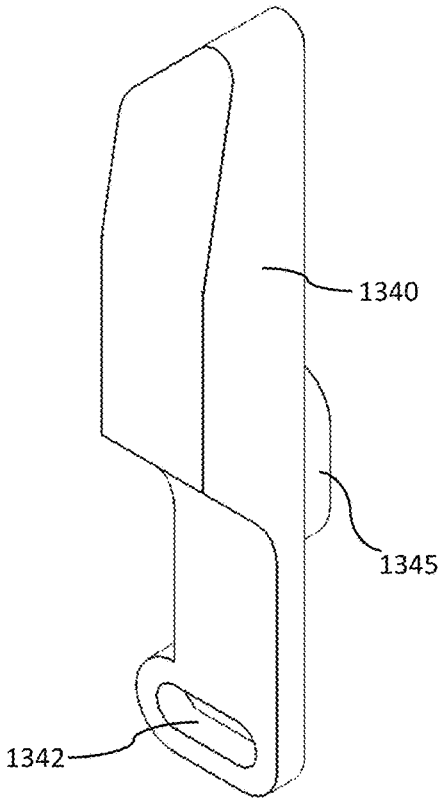
FIG. 13A is a perspective view of a latch pin lever according to a preferred embodiment of the present invention.
Figure 13B:
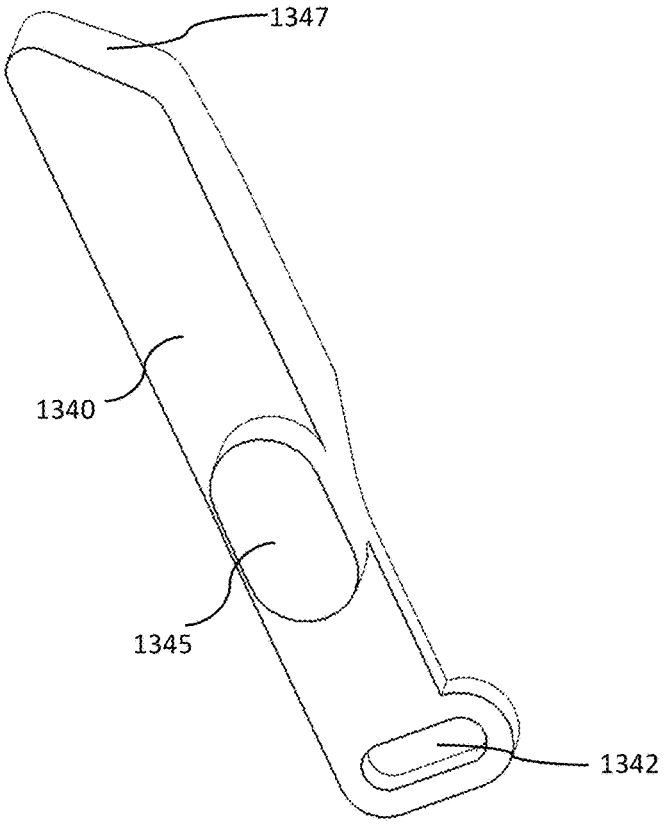
FIG. 13B is a perspective view of a latch pin lever according to a preferred embodiment of the present invention.

FIGS. 13A and 13B show a latch pin lever 1340 according to a preferred embodiment of the present invention. FIGS. 13A and 13B show that the latch pin lever 1340 can have a length this longer than either the width or thickness of the latch pin lever 1340. One end of the latch pin lever 1340 can include a slot or opening 1342 that extends through the entire thickness of the latch pin lever 1340. Optionally, it is possible that the slot 1342 can be a recess or groove that does not extend all the way through the latch pin lever 1340. The slot 1342 can fit over a protrusion on the trigger and allows the protrusion to travel within the slot 1342 during the firing action.

The latch pin lever 1340 can also include a protrusion 1345. As shown in FIGS. 13A and 13B, the protrusion 1345 can be integrally defined in one surface of the latch pin lever 1340 and can be oval or elliptical shaped. The protrusion 1345 can fit into a recess or groove in the frame, as discussed above.

The latch pin lever 1340 can also include a surface 1347 that is angled or pointed at an end of the latch pin lever 1340, opposite to an end of the latch pin lever 1340 with the slot 1342. The vertex of the angled surface 1347 points in a direction toward the latch pin such that the angled surface 1347 is in slideable contact with the latch pin, as shown in FIG. 10. When the latch pin lever 1340 is forced toward the latch pin during the firing sequence, the contact point of the latch pin to the latch pin lever 1340 moves down the angled surface 1347 towards the wider portion of the latch pin lever 1340, moving the latch pin forward. The farther down the contact point slides on the angled surface 1347, the farther the latch pin is pushed forward, shown in in FIG. 15 with the trigger 1520 pulled.

Figure 14:
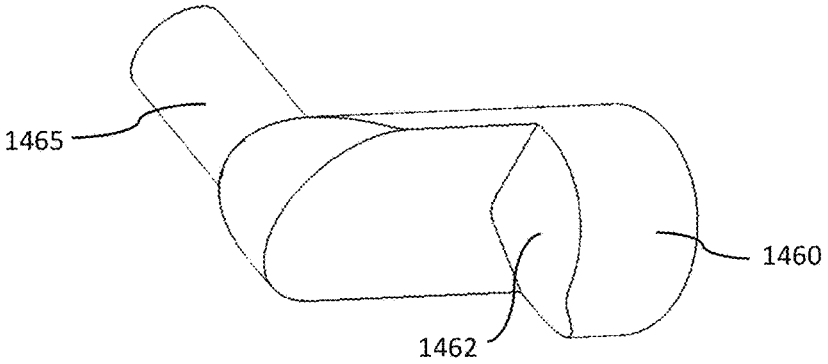
FIG. 14 is a perspective view of a latch pin according to a preferred embodiment of the present invention.

FIG. 14 shows a latch pin 1460 according to a preferred embodiment of the present invention. As shown in FIG. 14, the latch pin 1460 can include a generally cylindrical body with a portion removed to define a contact surface 1462 and a cylindrical stop 1465. The latch pin 1460 can be located in a recessed position of the frame such that it is in contact with the cylinder and can move forward and backward during the firing action. During the firing sequence, the latch pin lever is forced against the contact surface 1462 of the latch pin 1460, moving the latch pin 1460 forward. The stop 1465 protrudes from the latch pin 1460, is located in a slot in the frame, and slides in the slot in the frame during the firing action. After firing and the trigger is released, the cylinder spring pushes the cylinder and latch pin 1460 backward and the stop 1465 contacts an end of the slot in the frame to stop rearward movement.

Figure 15:
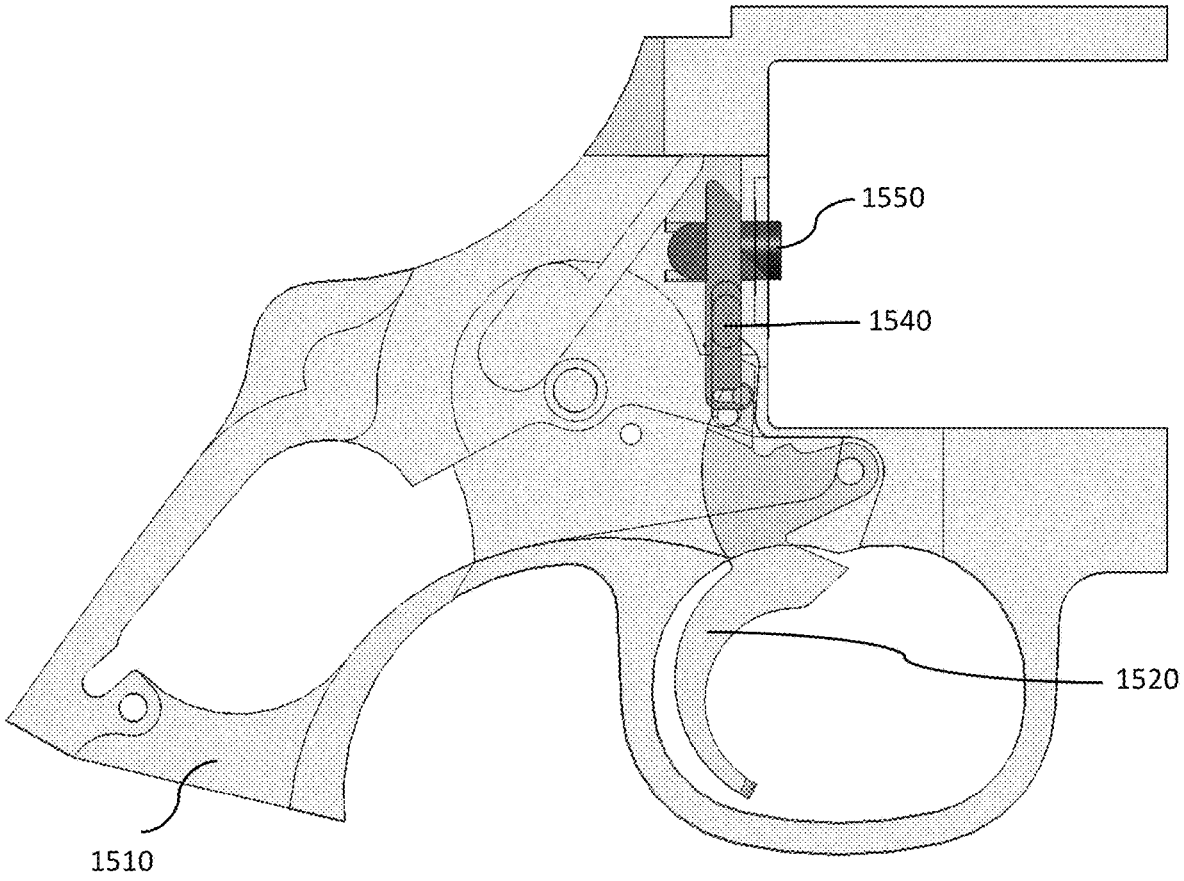
FIG. 15 is a side view of a frame according to a preferred embodiment of the present invention.

FIG. 15 shows a side view with the frame 1510 drawn as transparent, similar to FIG. 10, but with the trigger 1520 pulled. FIG. 15 shows that, with the trigger 1520 pulled, the rotation of the trigger 1520 moves the latch pin lever 1540 upward towards the latch pin 1550 forcing the latch pin 1550 forward though an opening in the frame 1510 to force the cylinder forward to contact the barrel and to seal the gap between the cylinder and the barrel.

The advantages of the second preferred embodiment are the same as those discussed above with respect to the first preferred embodiment.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A firing mechanism for a firearm, the firing mechanism comprising:

a trigger;

a forcing structure; and a spring within a cylinder; wherein while the trigger is pulled, the forcing structure moves to force the cylinder to contact a barrel and to force the spring to compress, and while the trigger is returned to an idle position, the forcing structure moves to allow the spring to decompress and to force the cylinder away from the barrel.

2. The firing mechanism according to claim 1, wherein the spring is in a bore of the cylinder.

3. The firing mechanism according to claim 2, wherein the spring is helical and retained between the cylinder and a crane.

4. The firing mechanism according to claim 1, wherein the barrel includes a conical taper at a rear end of the barrel, and the cylinder includes a conically tapered counter bore at a front end of a chamber closest to the barrel.

5. The firing mechanism according to claim 4, wherein the conically tapered counter bore fits over the conical taper at the rear end of the barrel and seals or substantially seals the barrel and the conically tapered counter bore.

6. The firing mechanism according to claim 1, wherein the forcing structure includes a latch pin lever and a latch pin.

7. The firing mechanism according to claim 6, wherein the latch pin lever pivots to force the latch pin in a direction parallel or substantially parallel to a bore of the barrel.

8. The firing mechanism according to claim 6, wherein a direction of movement of the latch pin lever is perpendicular or substantially perpendicular to a direction of movement of the latch pin.

9. The firing mechanism according to claim 8, wherein the latch pin lever includes an angled surface such that a vertex of an angle of the angled surface extends in a direction toward a latch pin, and the angled surface is in slideable contact with the latch pin.

10. The firing mechanism according to claim 6, wherein the latch pin includes a groove that is in slideable contact with the latch pin lever.

* * * * *